US010201889B2

(12) United States Patent
Morris et al.

(10) Patent No.: US 10,201,889 B2
(45) Date of Patent: Feb. 12, 2019

(54) FULLY ROTATABLE GRINDER GUARD ASSEMBLY AND METHOD FOR MAKING SAME

(71) Applicant: Sparky Guard, LLC, Austin, TX (US)

(72) Inventors: Lane Morris, Austin, TX (US); David Garza, Giddings, TX (US)

(73) Assignee: Sparky Guard, LLC, Austin, TX (US)

( * ) Notice: Subject to any disclaimer, the term of this patent is extended or adjusted under 35 U.S.C. 154(b) by 48 days.

(21) Appl. No.: 14/453,213

(22) Filed: Aug. 6, 2014

(65) Prior Publication Data

US 2016/0039068 A1 Feb. 11, 2016

(51) Int. Cl.
*B24B 55/05* (2006.01)
*B24B 23/02* (2006.01)
*B24B 55/04* (2006.01)

(52) U.S. Cl.
CPC ..... *B24B 55/052* (2013.01); *B24B 23/02* (2013.01); *B24B 55/04* (2013.01); *B24B 55/05* (2013.01)

(58) Field of Classification Search
CPC ..... B24B 55/04; B24B 55/05; B24B 55/052; B24B 23/02
USPC ..... 451/353, 455
See application file for complete search history.

(56) References Cited

U.S. PATENT DOCUMENTS 2,517,847 A * 8/1950 Crossland ..... B62L 5/14 192/217.6
3,969,856 A 7/1976 Zerrer
4,060,940 A * 12/1977 DeWitt ..... B25F 5/026 451/358
4,574,532 A * 3/1986 Haberle ..... B24B 55/052 144/251.2
4,924,635 A * 5/1990 Rudolf ..... B24B 55/052 451/344
5,005,321 A * 4/1991 Barth ..... B24B 55/052 451/359
5,074,044 A * 12/1991 Duncan ..... B23D 59/006 125/13.01
5,384,985 A * 1/1995 Jacobsson ..... B24B 55/052 451/344
5,440,815 A * 8/1995 Inkster ..... B27G 19/04 30/390
5,637,035 A 6/1997 Yee
5,766,062 A * 6/1998 Edling ..... B23Q 11/0092 451/359
6,464,573 B1 * 10/2002 Keller ..... B23Q 11/06 451/359
6,669,544 B1 * 12/2003 Walz ..... F16B 2/185 451/451

(Continued)

*Primary Examiner* — Eileen Morgan
(74) *Attorney, Agent, or Firm* — Frank M. Scutch, III

(57) ABSTRACT

A fully rotatable guard assembly (200) for use with a tool having a rotating disc includes at least one rotatable bearing (215, 223) for positioning on a shaft behind a rotating disc (207). A shield (203) works with the rotatable bearing (215, 223) for preventing sparks or other debris from being projected toward a user. A brake lever (241) is attached to the shield (203) for allowing the user to position the shield (203) at a predetermined position in relation to the rotating disc. The shield (203) is configured to cover approximately one-half (½) of the rotating disc (207) such that the position of the shield (203) can be easily rotated through use of the brake lever (241) for enabling the user to move the shield (203) such that the rotating disc (207) can access a workpiece.

4 Claims, 7 Drawing Sheets

(56) References Cited

U.S. PATENT DOCUMENTS 6,699,114 B1 * 3/2004 Booeshaghi ..... B23Q 1/52 451/451
6,893,334 B1 * 5/2005 Stivers ..... B24B 55/052 451/354
6,949,017 B2 * 9/2005 Koschel ..... B24B 55/052 451/358
6,988,939 B2 * 1/2006 Hofmann ..... B23Q 1/017 359/451
7,063,606 B2 * 6/2006 Stierle ..... B24B 55/052 451/359
7,089,671 B2 * 8/2006 Haneda ..... B27G 19/04 30/374
7,311,589 B2 * 12/2007 Wiker ..... B23Q 11/06 451/359
7,524,239 B2 * 4/2009 Schmidberger-Brinek ..... B24B 23/028 451/359
7,628,682 B2 12/2009 Andrasic et al.
7,736,217 B2 * 6/2010 Blatz ..... B23Q 11/06 451/451
7,909,680 B2 * 3/2011 Boeck ..... B24B 23/02 451/344
8,137,164 B2 * 3/2012 Boeck ..... B24B 23/02 451/454
8,282,446 B2 10/2012 Sulea et al.
8,460,070 B2 * 6/2013 Boeck ..... B24B 23/00 451/359
2002/0157265 A1 * 10/2002 Haneda ..... B27G 19/04 30/391
2004/0014412 A1 * 1/2004 Hofmann ..... B23Q 1/017 451/451
2006/0052041 A1 * 3/2006 Wiker ..... B23Q 11/06 451/451
2007/0065242 A1 * 3/2007 Skradski ..... B23Q 11/0046 408/67
2009/0156105 A1 6/2009 Widmer et al.
2009/0311953 A1 * 12/2009 Maute ..... B23Q 11/06 451/359
2010/0210196 A1 8/2010 Hosokawa et al.
2012/0270480 A1 * 10/2012 Rohde ..... B23D 45/16 451/451
2013/0165030 A1 6/2013 Copeland, Jr. et al.

* cited by examiner

700

800

FULLY ROTATABLE GRINDER GUARD ASSEMBLY AND METHOD FOR MAKING SAME

FIELD OF THE INVENTION

The present invention relates generally to machine tools and more particularly to a mechanical guard for use with a grinder tool or other tools having rotating disc surfaces.

BACKGROUND OF THE INVENTION

Fixed guards used with grinder tools are well known in the art for preventing sparks or debris from being throwing at the tool operator. A grinding tool or "grinder" is a handheld power tool used for cutting, grinding and polishing various materials such as metal.

BRIEF DESCRIPTION OF THE FIGURES

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the present invention.

Figure 1:
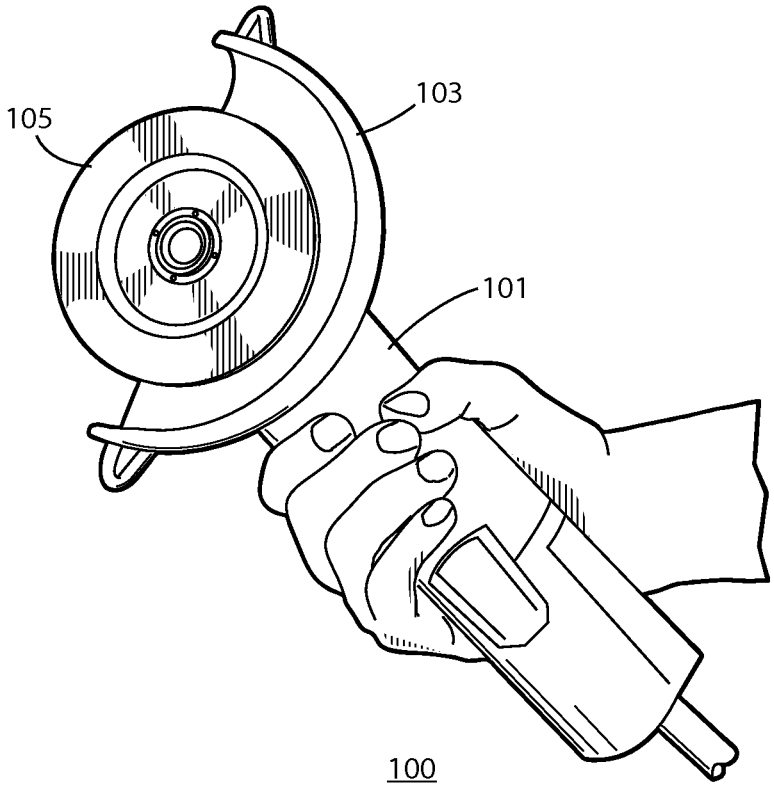
FIG. 1 Prior Art
FIG. 1 illustrates a perspective view of a grinder guard as typically used in the prior art.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION

Before describing in detail embodiments that are in accordance with the present invention, it should be observed that the embodiments reside primarily in combinations of method steps and apparatus components related to a fully rotatable grinder guard. Accordingly, the apparatus components and method steps have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

In this document, relational terms such as first and second, top and bottom, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises . . . a" does not, without more constraints, preclude the existence of additional identical elements in the process, method, article, or apparatus that comprises the element.

Tool grinders are also sometimes referred to as an angle grinder, side grinder or disc grinder and can be powered by an electric motor, gas engine or compressed air. The tool is configured such that a motor drives a geared head at a right-angle. The head is mounted on an abrasive disc or alternatively a thin profile cut-off disc. Angle grinders typically have an adjustable guard and a side-handle for two-handed operation. Specific angle grinders, depending on their speed range, can be used as a sander, employing a sanding backing having a sanding pad. The backing system is typically made of hard plastic, phenolic resin, or medium-hard rubber depending on the amount of flexibility desired.

A guard shield is standard equipment on a grinder and works to cover the spinning grinding disc during its operation. As seen in prior art FIG. 1, the guard assembly 100 includes a grinder 101 having a guard housing 103 that surrounds the spinning disc 105. The guard housing 103 is fixed into one position in relation to the grinder 101 and cannot be moved. Various federal regulations from The National Institute for Occupational Safety and Health (NIOSH), Occupational Safety and Health Administration (OSHA) as well as product liability concerns require that a grinder guard be attached to every type of grinder. In use, the grinder guard is designed to cover approximately fifty percent (50%) of the grinder wheel's diameter. The guard, as used in the prior art, may also have some rotation but generally only 180 degrees or less. These guards are often attached to the tool handle to help prevent sparks or flying debris from being projected towards the user of the tool. Additionally, the guard also protects the user from touching or having clothing or hair being caught in the grinder wheel while it is spinning.

A problem often encountered with the grinder guard occurs when the guard is in the way of a user's view when trying to complete their job. For example, when using a grinder around the surface of a pipe, only a limited portion of the pipe can be accessed because the guard moves in the view of the user and prevents the job from being easily completed without getting underneath the pipe. In order to use the tool with the guard, the user has to stop their job and physically move around in different angles to cover all their areas to grind. Alternatively, the user would need a tool to loosen the guard to move it around the grinder wheel and tighten it before using it again. Consequently, it is a common practice in the industrial and construction trades to detach and/or physically remove the guard from the tool so the guard will not block access to the pipe or other workpiece.

After the guard is removed, still another serious hazard can result when the user rests the tool on a table or the floor with the disc still spinning. While the disc is turned off and/or spinning down, the heavy grinding tool can unexpectedly walk or skip as the spinning disc makes contact with the surface of the table or floor. Obviously, this can create another hazard to the user or others in the vicinity of the moving tool. Consequently, it would be advantageous to provide a guard that provides safety to the user while still allowing the tool to be used in a variety of work environments.

Figure 2:
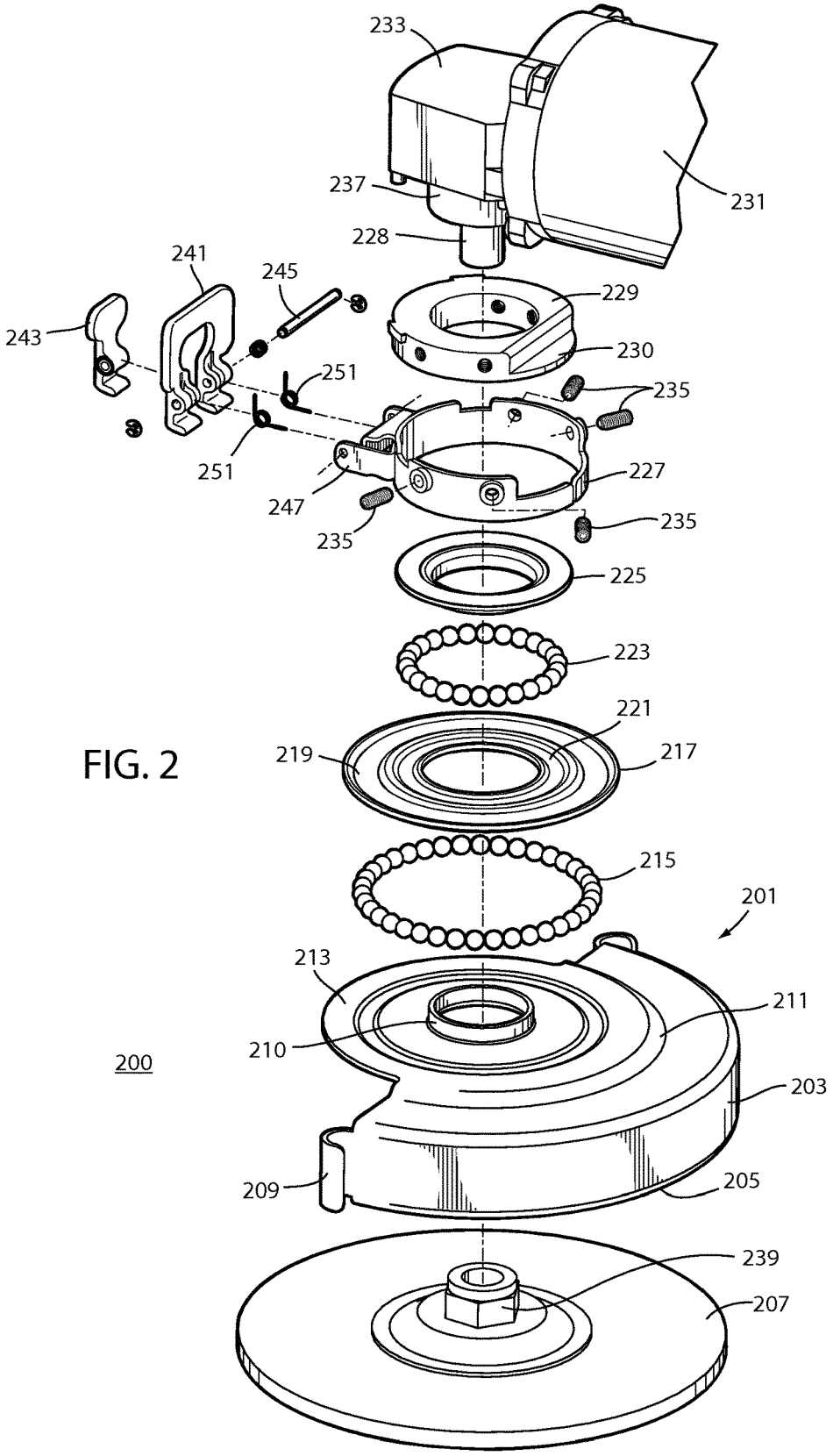
FIG. 2 illustrates an exploded view of the grinder guard assembly in according with an embodiment of the invention.

FIG. 2 illustrates an exploded view of the grinder guard in accordance with an embodiment of the invention. The grinder guard 200 includes a shroud-like cover or shield 201 having a concave inner surface, an outer edge 203 and lip 205 that forms a shell-like shape for wrapping around the outer edge of grinder's spinning disc 207. The spinning disc is secured to a spindle 228 using bolt 239. The lip 203 includes curled edges 209 for providing a blunt edge for the user to touch and position the guard. As will be described herein, the shape of the grinder guard allows the shield 201 to safely protect the user from sparks and flying debris that are projected for at least 180 degrees around the grinding disc 207.

The outer surface 211 of the shield 201 includes a race or channel 213 for providing a plurality of first ball bearings 215 a path or track for movement in a substantially circular motion. A guard mount 217 is placed on top of the first ball bearings 215 and works to hold the first ball bearing 215 into a fixed position on top of the outer surface 211. The guard mount 217 is placed on top of the outer surface 211. An inner surface 219 of the guard mount 217 also includes a race or channel 221 used in connection with a plurality of second ball bearings 223 for holding the second ball bearings 223 in position for movement in a substantially circular motion. The shield lock 225 is used to provide a force for holding the second ball bearings 223 in the channel 221. As seen in FIG. 2, the circumference of the first ball bearing 215 is greater and approximately twice that of the second ball bearings 223. Additionally, the shield lock 225 also operates to secure the entire bearing assembly comprised of the first ball bearings 215, guard mount 217, second ball bearings 223 and is glued and/or otherwise fastened to the shield lip 210. As described herein, the guard ring 227 is mechanically fastened or welded to the guard mount 217. As will be further described herein, the guard ring 227 is also used for fastening both a drag paddle and lock paddle thereto. The bearing assembly allows the shield 201 to be easily rotated a full 360 degrees about the grinding disc 207.

The grinder guard further includes a spacer 229 that is positioned between the guard ring 227 and grinder tool 231. The spacer may be pliable and is made of plastic or rubber that is specially shaped, sized and individually selected depending on the brand of grinder tool 231. For example, a Makita grinder will use its own, specially sized, spacer while a DeWalt grinder will use a differently sized spacer for that tool. The spacer 229 is positioned around the grinder housing 237 and works to ensure that there is a proper fit to a particular grinder model. The spacer 229 includes a tongue 230 for correctly positioning the spacer 229 into the guard ring 227 such that it fits therein in only one position or direction. The spacer 229 is then securely fastened within the guard ring 227 using one or more screw fasteners 235. Those skilled in the art will recognize that the guard ring 227 along with a spacer 229 is used to hold in place the guard assembly to grinder tool 231.

As seen in FIG. 2, the grinder guard 200 also includes a brake assembly having a lever such drag paddle 241, lock paddle 243 and a pin 245 for fastening both paddles to a bracket 247. The bracket 247 is attached to one side of the guard ring 227. The lock paddle 243 is smaller in size and is positioned within the drag paddle 241 so that it can be biased with one or more spring members 251. When pressed in a lever action, the drag paddle 241 exerts a force against the shield 211 in a downward manner to frictionally engage with the shield 201 thereby slowing and/or stopping rotation of the shield 201. If the user decides that the position of the shield 201 is to be fixed, then the lock paddle 243, when pushed, works to hold the drag paddle 241 down into a locked position. Pushing the drag paddle 241, a second time, allows the lock paddle 243 to disengage so the shield 201 can move again. In use, the drag paddle 241 allows the user of the grinding tool to easily set the position of the shield 201 for gaining access to a workpiece without having to change position or orientation of the grinding tool.

Figure 3:
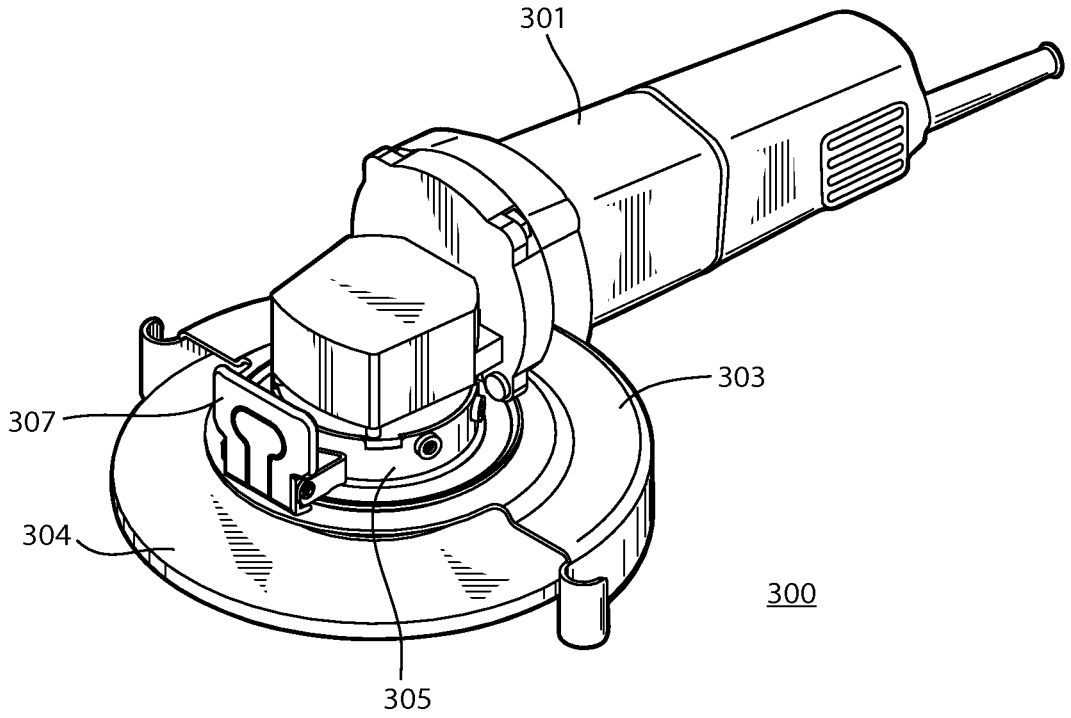
FIG. 3 illustrates a perspective view of the grinder guard assembly shown according to an embodiment of the invention.

FIG. 3 illustrates a perspective view of the grinder guard shown according to an embodiment of the invention where the grinder guard is attached to a grinder. The grinder and guard assembly 300 include a rotary grinder tool 301 and the grinder guard 303. The spacer 305 is shown for allowing the grinder guard 303 to properly attach to the tool with the correct spatial distance between the grinder guard 303 and grinding disc or wheel 304. The drag paddle 307 is shown at the top of the grinder guard 303 and is shown in an unlocked position.

Figure 4:
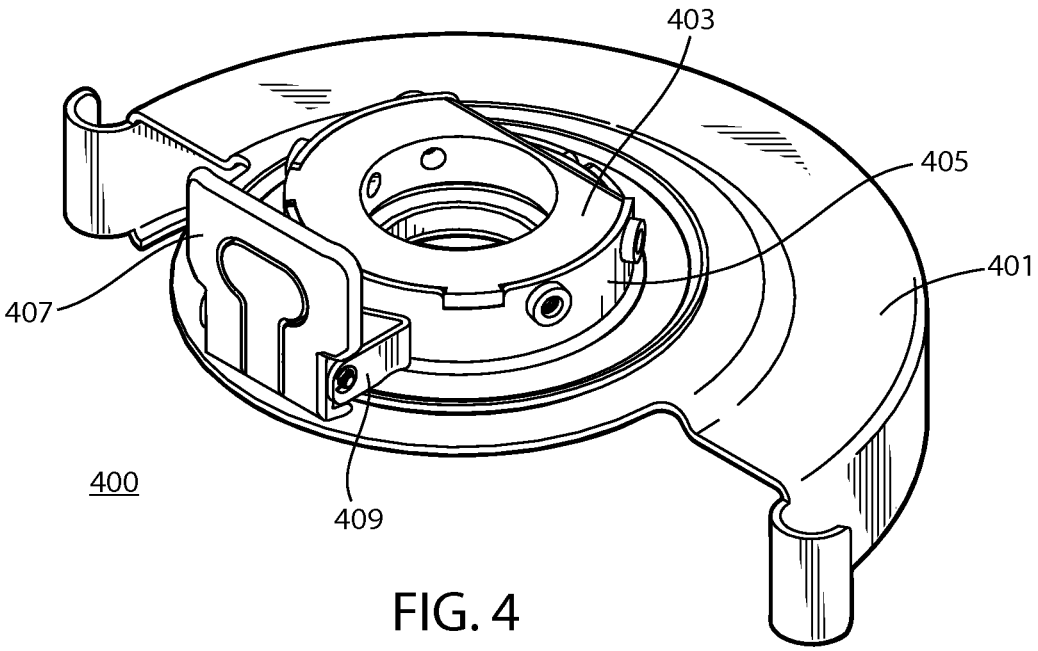
FIG. 4 is a perspective view of the grinder guard assembly showing the outside of the shield and spacer.

FIG. 4 is a perspective view of the grinder guard showing the outside of the shield and spacer. The grinder guard 400 is illustrated showing the shield 401 where the spacer 403 is fastened within the ring 405. As described herein, different spacers 405 are available depending on the specific type or brand of grinder tool. This enables the grinder guard 400 to fit securely to the tool without wobble or other unwanted movement. The drag paddle 407 is illustrated attached to bracket 409.

Figure 5:
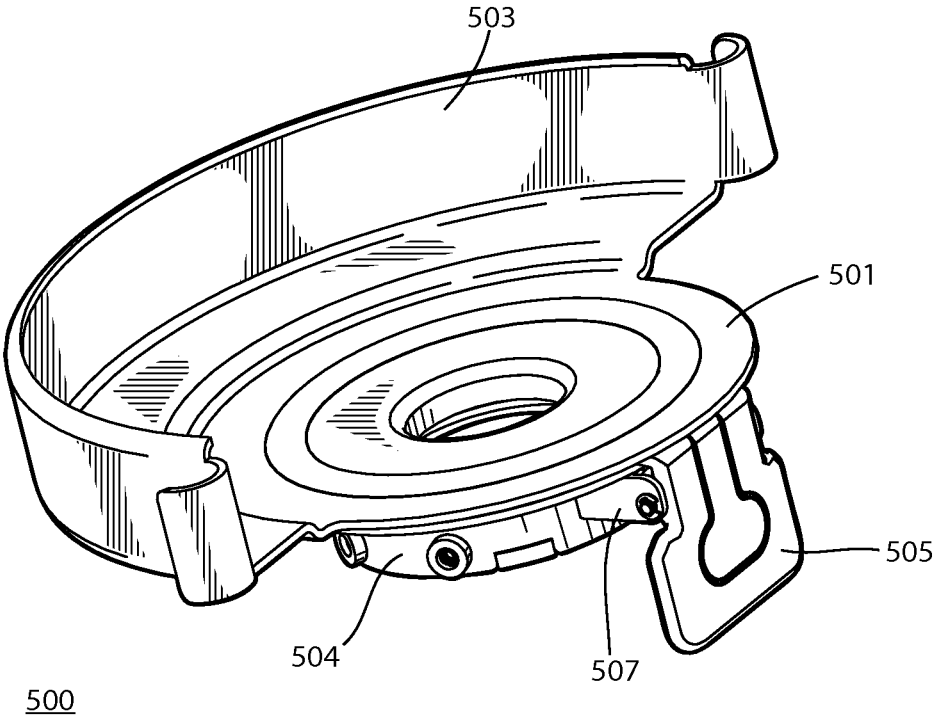
FIG. 5 is a perspective view of the grinder guard assembly showing the inside of the shield.

FIG. 5 is a perspective view of the grinder guard showing the inside of the shield. The grinder guard 500 includes the shield 501 turned to show its inside surface and lip 503. A spacer is positioned within the ring 504. The drag paddle 505 is shown attached to bracket 507.

Figure 6:
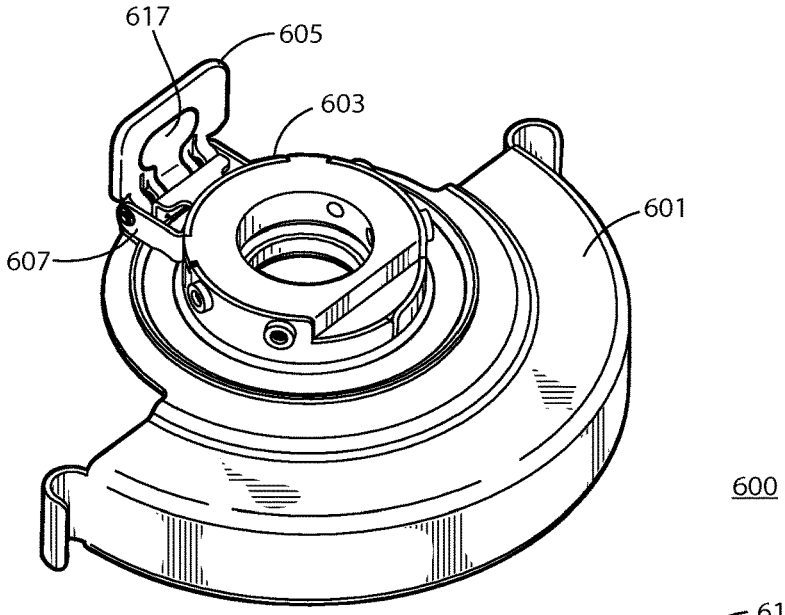
FIG. 6 is a perspective view of the grinder guard assembly showing the paddle for operating the brake assembly.
Figure 6A:
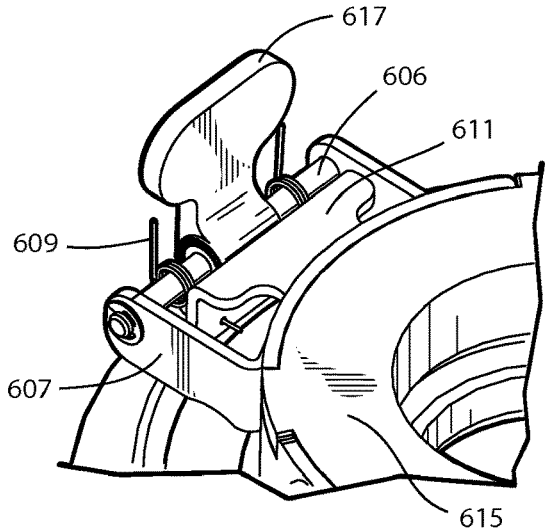
FIG. 6A is a magnified view of a side of the paddle assembly shown in FIG. 6.
Figure 6B:
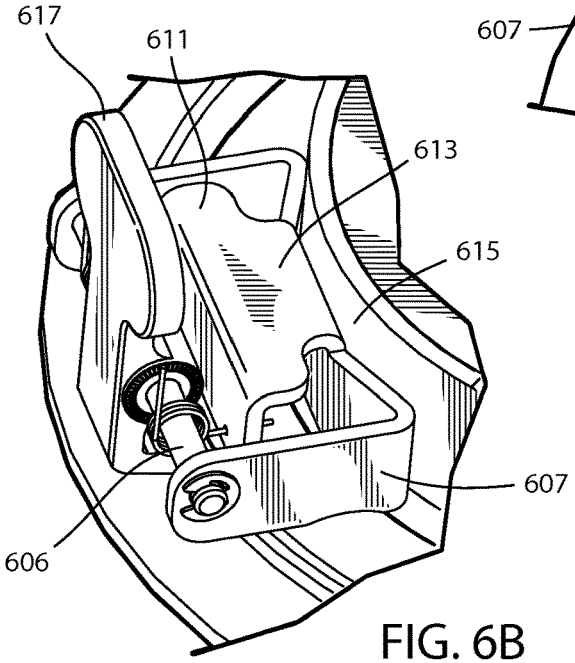
FIG. 6B is a magnified view of the front of the paddle assembly shown in FIG. 6.

FIG. 6 is a perspective view of the grinder guard showing the paddle for operating the brake assembly. Additionally, FIG. 6A is a magnified view of a side of the paddle assembly shown in FIG. 6. FIG. 6B is a magnified view of the front of the paddle assembly shown in FIG. 6. The grinder guard 600 is illustrated showing the shield 601 and guard ring 603. The drag paddle 605 is shown attached to bracket 607. FIG. 6A and FIG. 6B illustrate the drag paddle 605 connected to bracket 607 using pin 609. The drag paddle 605 is pushed downward using a biasing force from spring 609. In use, a bottom portion of the drag paddle 605 pushes outwardly against guard 601. As best seen in FIG. 6B, the brake paddle 617 works to contact the side of guard 601 to provide the braking force necessary to stop or hold the rotating guard 601 into a fixed position. As described herein, if the user intends for the brake to stay engaged, the lock paddle 617 is pressed to hold the drag paddle 605 into a fixed and rigid position.

Figure 7:
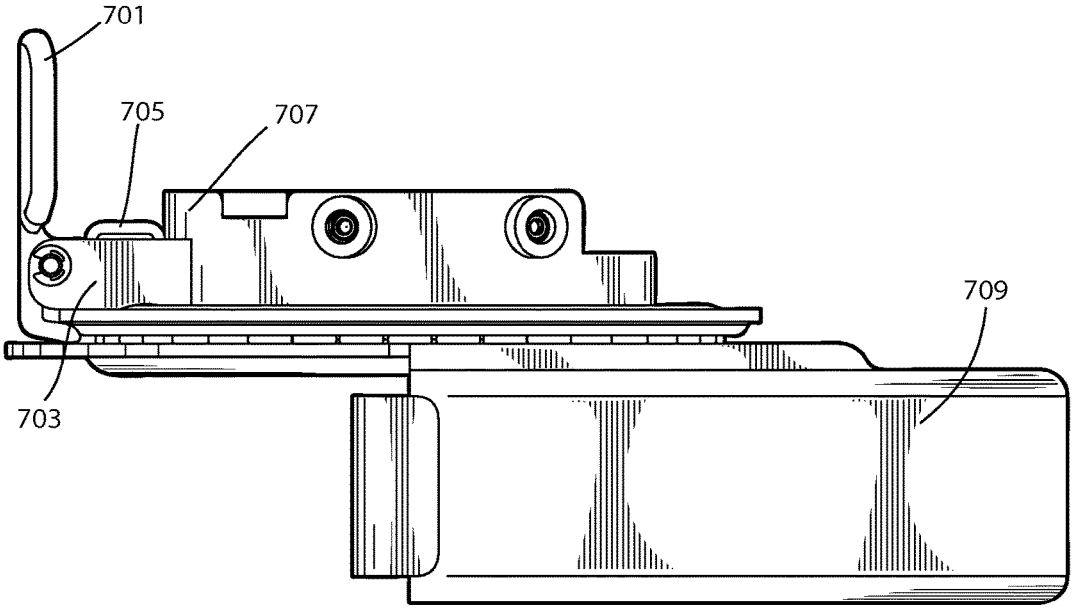
FIG. 7 is a top view of the grinder guard assembly shown in FIG. 4.

FIG. 7 is a top view of the grinder guard shown in FIG. 4. The grinder guard 700 includes a drag paddle 701 attached to bracket 703. The drag paddle 701 when pressed downwardly operates the brake when pressed against the shield 709 to slow or stop rotation of the shield 709.

Figure 8:
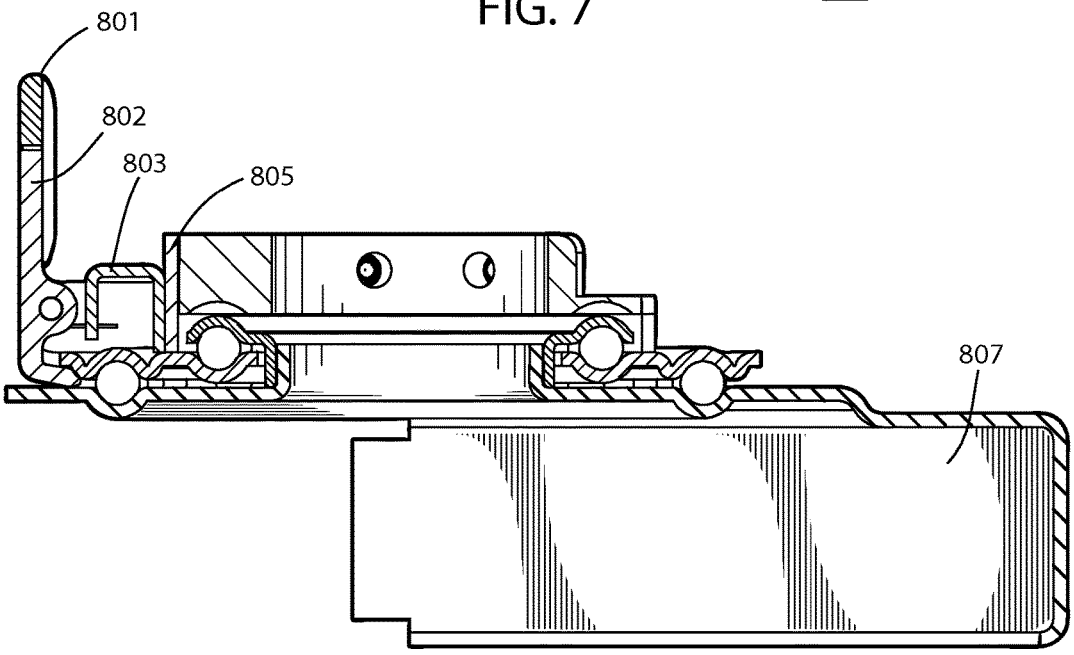
FIG. 8 is a bottom sectional view of the grinder guard.

FIG. 8 is a top sectional view of the view shown in FIG. 7. The grinder guard 800 includes the drag paddle 801 and lock paddle 802 operating the brake. The drag paddle 801 contacts the guard to slow or stop rotation of the shield 807.

Figure 9:
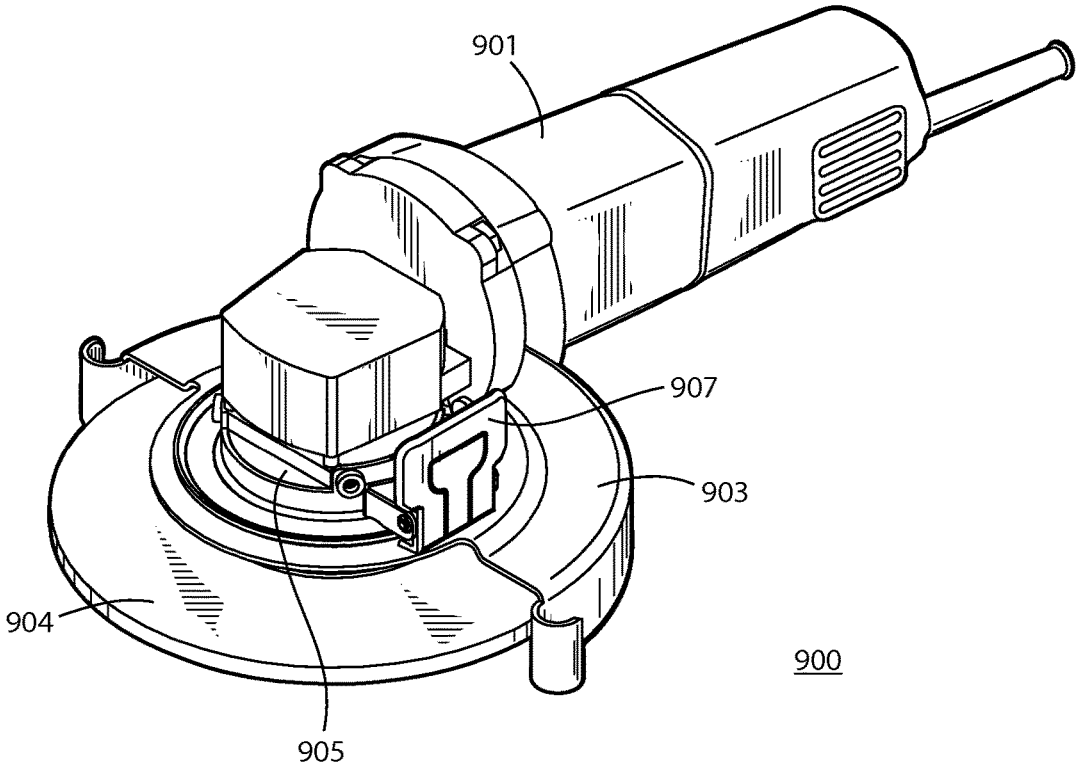
FIG. 9 is a perspective view of an alternative embodiment of the grinder guard showing the paddle assembly moved 90 degrees relative to the shield.

FIG. 9 is a perspective view of an alternative embodiment of the grinder guard assembly showing the paddle assembly moved approximately 90 degrees relative to the shield. The grinder and guard assembly 900 include a rotary grinder tool 901 and the shield 903. The spacer 905 is shown for allowing the shield 903 to properly attach to the tool with the correct spatial distance between the grinder guard 903 and grinding disc or wheel 904. The drag paddle 907 is shown at the side of the grinder guard 903 and is shown unlocked. In this embodiment, the drag paddle 907 can be easily operated with the user's thumb while holding the grinder tool 901 with their right hand or rotated 180 degrees for left handed operation. As seem in FIG. 9, the drag paddle 907 extends and is positioned approximately 90 degrees relative to the grinder tool body.

Thus, the embodiments of present invention provide a fully rotatable grinder guard allowing a moveable, free flowing shield that a user can easily position 360 degrees around a grinder wheel—while the grinder is in use. This allows a grinder wheel to contact a pipe surface completely around the circumference of a pipe such that the shield or "guard" rotates around a 360 degree arc, protecting the user from sparks and flying debris, as the tool is rotated. The guard includes a paddle that operates a brake assembly that can be easily pressed while holding the grinder. The brake paddle is resilient and allows the user to apply a biasing force with just enough pressure to keep the guard in a position so the rotating disc can freely rotate at any desired angle of use. Since the rotatable guard is resilient, it moves back to a predetermined position after use so that when the grinder tool is released, or is set upon the ground or other surfaces, the rotatable guard will return to its closed position preventing the grinding wheel or other disc from touching the surface or the user's body while still spinning. The present invention includes spacers for attaching the guard to any type of grinder. It is easy to install, allowing the tool to have more utility while preventing harm to the user from flying debris and walking or skipping when the user is finished with the tool while the wheel or abrasive disc is still spinning. Moreover, the present invention prevents safety violations from occurring since users will not be compelled to remove the guard.

In the foregoing specification, specific embodiments of the present invention have been described. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of present invention. The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

We claim:

1. A shield assembly for use with a power tool having a spindle for rotating a disc, the shield assembly comprising: a rotatable shield mounted for rotation about the spindle and arranged partially around the disc, the shield having a first channel on one side thereof with a first plurality of bearings positioned in said first channel; a guard mount configured around the shaft having a first side arranged adjacent the first plurality of bearings; the guard mount having a second channel on a side opposite the first side for guiding a second plurality of bearings positioned in said second channel for enabling movement of the rotatable shield about the spindle in cooperation with the first and second plurality of bearings; a brake assembly comprising a shield lock adjacent to the second plurality of bearings for locking and releasing movement of the second plurality of bearings and the first plurality of bearings, wherein the position of the rotatable shield about the spindle is controlled through use of the brake assembly for enabling the rotatable shield to be freely rotatable about the spindle in a non-braking position and to be set in relation to the disc in a braking position.

2. A shield assembly as in claim 1, further comprising a spacer positioned between the rotatable shield and power tool for providing proper alignment of the power tool to the rotatable guard.

3. A shield assembly as in claim 1, wherein the rotatable shield returns to a predetermined position when no force is applied to the brake assembly for preventing the rotating disc from contacting an undesirable surface.

4. A fully rotatable shield as in claim 1, wherein the power tool is an electric grinder.

* * * * *